United States Patent [19]

Creasy et al.

[11] Patent Number: 4,553,741

[45] Date of Patent: Nov. 19, 1985

[54] PLASTIC FENCE ASSEMBLY

[76] Inventors: Charles K. Creasy, Rte. 1, Box 107-B; Eustis Hendley, Rte. 1, Box 109-B, both of Brooklet, Ga. 30415

[21] Appl. No.: 657,678

[22] Filed: Oct. 4, 1984

[51] Int. Cl.[4] ..... E04H 17/14

[52] U.S. Cl. ..... 256/66; 256/50

[58] Field of Search ..... 256/59, 65, 66, DIG. 5, 256/21, 50

[56] References Cited

U.S. PATENT DOCUMENTS

| | | | |
|---|---|---|---|
| 917,083 | 4/1909 | Kyle | 256/52 |
| 2,955,799 | 5/1976 | Lauzier | 256/65 X |
| 3,107,900 | 10/1963 | DePaolo | 256/59 |
| 3,700,213 | 10/1972 | Blease . | |
| 4,140,298 | 2/1979 | Coleman, Jr. | 256/65 |
| 4,289,302 | 9/1981 | Montgomery . | |

FOREIGN PATENT DOCUMENTS

| | | | |
|---|---|---|---|
| 734057 | 7/1955 | United Kingdom | 256/65 |

*Primary Examiner*—Andrew V. Kundrat

*Attorney, Agent, or Firm*—Laurence R. Brown

[57] ABSTRACT

Hollow plastic posts and rails interlock to form fences. The posts are hollow cylindrical pipes having two axially spaced elongated ovalur slots through the shell thereof for receiving the rails. The rails are hollow plastic members having ovalur ends for mating into the slots on the post. The members are interlocked by forming flexible deformable rail ends with a width slightly greater than the length of the receptacle slots and notching the rail ends to register in place engaging the shell casing of the posts at the ends of the slots.

2 Claims, 3 Drawing Figures

PLASTIC FENCE ASSEMBLY

TECHNICAL FIELD

This invention relates to plastic fences and more particularly it relates to plastic fences with interlocking hollow rails and posts.

BACKGROUND ART

Long life fences of rail and post construction fabricated from non-decoyable materials such as plastic and concrete are known in the art, as set forth, for example in U.S. Pat. Nos. 3,700,213 to W. J. Blease of Oct. 24, 1972 and 4,289,302 to J. L. Montgomery of Sept. 15, 1981.

However, certain deficiencies exist in the prior art including features contributing to high cost, which have limited the use of such fencing construction. For example, complex dies need be made for intricate shapes involved.

It is therefore an objective of the present invention to improve the state of the art by providing low cost plastic fence construction features that produce a pleasing fence design appearance while achieving long wear maintenance free qualtities.

Other features, objects and advantages will be found throughout the following description, the claims and the drawings.

DISCLOSURE OF THE INVENTION

This invention therefore provides interlocking fencing rails and posts simply formed at low cost using extruded plastic members of the type available in high quantity low cost pipe production, namely soil pipe or plastic plumbing pipes. Low cost without compromise of life, appearance and installation features is achieved by novel interlocking features between posts and rails formed by very simple modification of the extruded hollow plastic tubing rail and post members.

Thus, basically both the rails and posts comprise hollow open ended extruded plastic tubings, the posts being cylindrically shaped and the rails being flattened into oval shaped members of predetermined width and thickness. The posts have a top cover cap and have cut through the cylindrical casing axially spaced oval slots for receiving the ends of mating rail members. The rails are ovel shaped of a dimension for snugly fitting the ends into the post slots. Interlocking structure is formed by simply notching the rails at a place near each end to interfit with the post casing at each end of the slots therein. Thus, the ends of the rails are flexibly deformable to manually insert a rail member slightly wider than the length of the post slot thereinto by manual deformation, so that the rail end may be pushed into the post cylinder far enough to snap the notches into registration with the cylinder casing at the ends of the slots.

BRIEF DESCRIPTION OF THE DRAWING

In the drawings like reference characters are used for similar features in the various views to facilitate comparison.

THE PREFERRED EMBODIMENT

Figure 1:
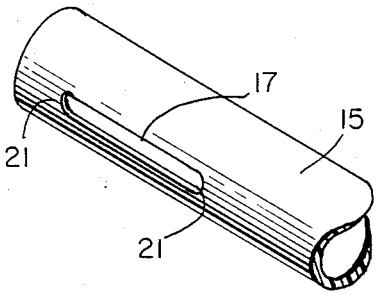
FIG. 1 is a perspective view of a fence post fragment embodying the invention.

As seen from the drawing, a fence is constructed of a set of spaced posts 15 having ends buried below ground 14. A set of rails 16 is suspended between the posts 15. The shown fence section and post structure can be extended to provide adjoining sections and corner sections by appropriate interfitting of rails in the posts in the manner that is set forth hereinafter.

Figure 3:
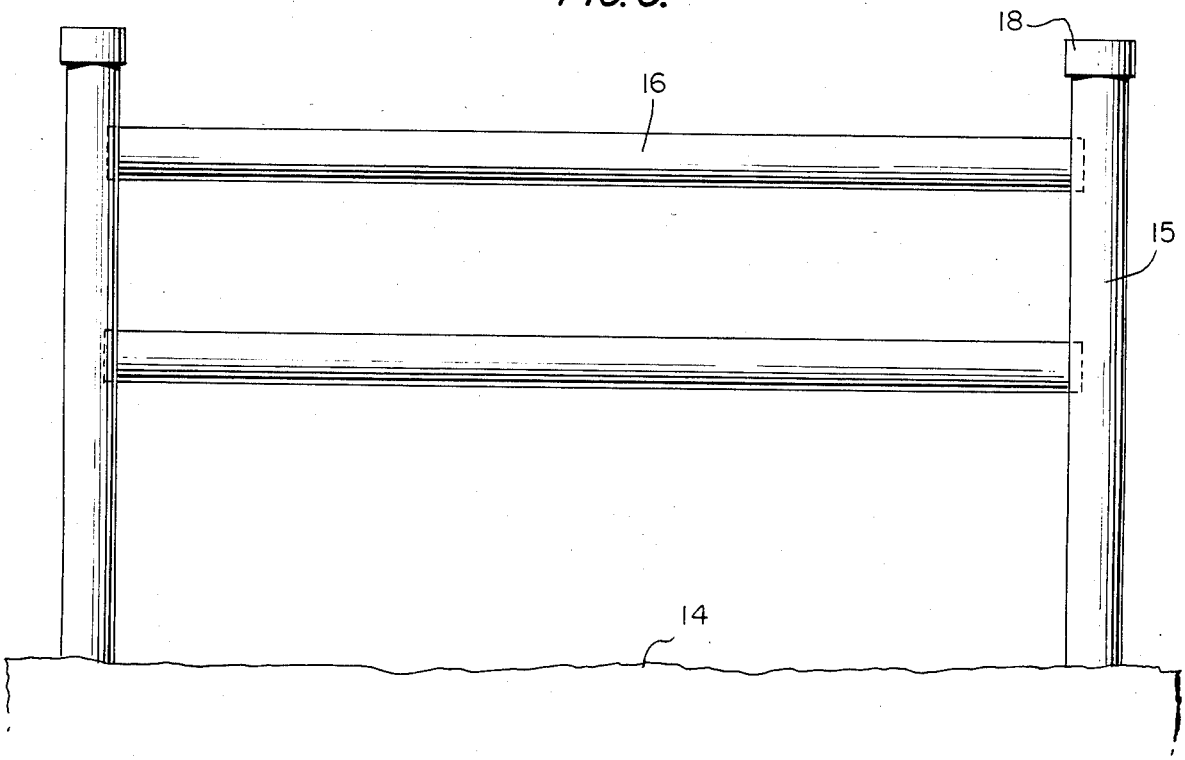
FIG. 3 is a profile view of a section of fence embodying the invention.

The posts 15, as best seen from FIG. 1, simply are extruded plastic hollow cylindrical pipe members having rail mounting slots 17 or elongated oval apertures through the casing at two or more axially spaced locations to support the mating rails by insertion of the rail ends thereinto. These slots may be axially along only one line to form the fence section of FIG. 3, thus forming end posts, or they may have either another set of slots diametrically opposed to continue adjacent fence sections or disposed in a plane perpendicular to the fence line to constitute a corner post. Cap 18 is a standard item. The posts may be formed of standard three or four inch diameter plastic plumbing pipe sections of polyvinylchloride or ABS which are solvent, weldable and thus the cap 18 may be a standard plumbing fixture plastic welded in place. A metal pipe could be used at higher cost, and for purposes of this invention is considered an equivalent included in the term plastic.

Figure 2:
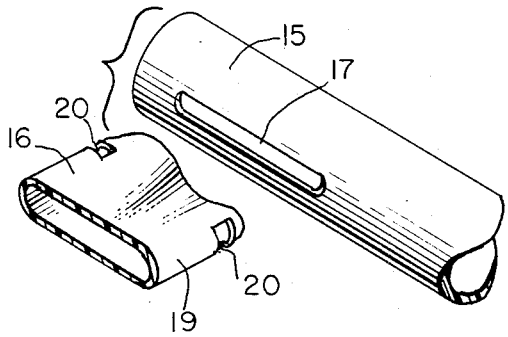
FIG. 2 is a fragmentary perspective view of the interlocking joint structure between rail and post, as afforded by this invention.

The rails 16, as best seen from FIG. 2, are also preferably extruded hollow plastic pipes of oval shape having open ends that register into the post slots 17. Thus, the rails 16 simulate flat boards of predetermined width and thickness, rounded into oval shape. The ability to use extruded piping for both the posts and rails avoids the necessity to use expensive dies, etc. in forming interlocking fence members. It is unexpected and unobvious to thus be able to simplify the fencing art and reduce costs over previous constructions such as that of U.S. Pat. No. 3,700,213 hereinbefore identified.

The rails 16 may be interfitted into slots 17 and plastic welded in place if desired, and need not have interlocking structure if the spacing between adjacent posts 15 is within appropriate tolerance with respect to the length of the rails 16. However, mechanically interlocking structure is simpler and thus preferred, and is easily achieved in accordance with this invention by simply cutting, dimpling or notching the rails 16 close to the end at each oval shaped edge 19 in the manner illustrated at 20. Thus, the width of the rails 16 between the edges 19 is slightly greater than the length of the slots 17 in the posts, thereby allowing the end of the rail 16 to be manually flexed and distorted enough to enter the slot 17 and slide into place interlocking the notches 20 onto the post casing at the ends 21 of the slots 17. Thus, the railing material preferably is formed of a suitable manually flexible or distortable plastic as the open end of the rail 16. After mechanically interlocking, plastic welding can occur but is not necessary, nor desirable if the fence is to be later disassembled. Thus, a strong, inexpensive, long lasting fencing assembly of good appearance is afforded by this invention, advancing the state of the art.

Therefore those novel features believed descriptive of the nature and spirit of the invention are defined with particularity in the following claims.

We claim:

1. A fence section having two plastic fence posts comprising lengths of hollow cylindrical tubing anchored to stand vertically above the ground at a predetermined spacing and defining therein an axially spaced set of two or more axially elongated oval shaped apertures for receiving thereinto mating rails of elongated oval shape extending between two spaced posts and extending into the hollow cylindrical tubing of said posts, two hollow plastic rails held between said posts with oval shaped ends thereon mating with said oval shaped apertures of said posts, the rails being of a length substantially that of the predetermined spacing such that the ends thereof at opposite ends of the rail extend through the apertures into the hollow cylindrical tubing of the respective spaced posts, wherein the rails are flattened oval shaped members each having flexible deformable plastic ends with a slit on each side of the rail width through the oval shaped members near opposite ends and removed a short distance from the end of the rail, the rail width being slightly greater than the length of the apertures in the posts whereby the rail may be deformed to mate the slits to fit into locking engagement with the apertures in the posts.

2. Hollow plastic fence rails comprising lengths of hollow tubing of flexible plastic that may be deformed at each end presenting elongated oval shaped ends of predetermined width adapted to mate into elongated oval shaped slots in hollow plastic fence posts, and interlocking structure on the rail ends for mating into the oval slots comprising slits extending into the opposite sides of the oval shaped rail near each end for inserting into and lockingly engaging mating elongated oval shaped mating slots in the fence posts of a dimension fitting snugly into the slits and about the circumference of the remainder of the oval shaped rail member, whereby the ends of the rails may be flexibly deformed to insert and interlock into the mating slots in the fence posts.

* * * * *